US008335685B2

(12) United States Patent
Hetherington

(10) Patent No.: US 8,335,685 B2
(45) Date of Patent: Dec. 18, 2012

(54) AMBIENT NOISE COMPENSATION SYSTEM ROBUST TO HIGH EXCITATION NOISE

(75) Inventor: Phillip A. Hetherington, Port Moody (CA)

(73) Assignee: QNX Software Systems Limited, Kanata, Ontario (CA)

( * ) Notice: Subject to any disclaimer, the term of this patent is extended or adjusted under 35 U.S.C. 154(b) by 703 days.

(21) Appl. No.: 12/471,093

(22) Filed: May 22, 2009

(65) Prior Publication Data

US 2009/0287482 A1 Nov. 19, 2009

Related U.S. Application Data

(63) Continuation-in-part of application No. 12/428,811, filed on Apr. 23, 2009, and a continuation-in-part of application No. 11/644,414, filed on Dec. 22, 2006, now Pat. No. 7,844,453.

(60) Provisional application No. 61/055,913, filed on May 23, 2008.

(51) Int. Cl.
*G10L 21/00* (2006.01)
*G10L 19/14* (2006.01)
*G10L 21/02* (2006.01)

(52) U.S. Cl. ..... 704/225; 704/201; 704/226

(58) Field of Classification Search ..... None
See application file for complete search history.

(56) References Cited

U.S. PATENT DOCUMENTS 4,486,900 A 12/1984 Cox et al.
4,531,228 A 7/1985 Noso et al.
4,630,305 A 12/1986 Borth et al.
4,811,404 A 3/1989 Vilmur et al.
4,843,562 A 6/1989 Kenyon et al.
5,012,519 A 4/1991 Adlersberg et al.
5,027,410 A 6/1991 Williamson et al.
5,056,150 A 10/1991 Yu et al.
5,146,539 A 9/1992 Doddington et al.
5,313,555 A 5/1994 Kamiya
5,384,853 A * 1/1995 Kinoshita et al. ..... 381/71.12
5,400,409 A 3/1995 Linhard
5,426,703 A * 6/1995 Hamabe et al. ..... 381/71.12

(Continued)

FOREIGN PATENT DOCUMENTS

CA 2158847 9/1994

(Continued)

OTHER PUBLICATIONS

Gordy, J.D. et al., "A Perceptual Performance Measure for Adaptive Echo Cancellers in Packet-Based Telephony," IEEE, 2005, pp. 157-160.

(Continued)

*Primary Examiner* — Jesse Pullias

(74) *Attorney, Agent, or Firm* — Brinks Hofer Gilson & Lione

(57) ABSTRACT

A speech enhancement system controls the gain of an excitation signal to prevent uncontrolled gain adjustments. The system includes a first device that converts sound waves into operational signals. An ambient noise estimator is linked to the first device and an echo canceller. The ambient noise estimator estimates how loud a background noise would be near the first device before or after an echo cancellation. The system then compares the ambient noise estimate to a current ambient noise estimate near the first device to control a gain of an excitation signal.

26 Claims, 4 Drawing Sheets

U.S. PATENT DOCUMENTS

| | | | | |
|---|---|---|---|---|
| 5,479,517 | A | 12/1995 | Linhard | |
| 5,485,522 | A | 1/1996 | Solve et al. | |
| 5,495,415 | A | 2/1996 | Ribbens et al. | |
| 5,502,688 | A | 3/1996 | Recchione et al. | |
| 5,526,466 | A | 6/1996 | Takizawa | |
| 5,544,080 | A * | 8/1996 | Kobayashi et al. | 700/280 |
| 5,568,559 | A | 10/1996 | Makino | |
| 5,570,423 | A * | 10/1996 | Walker et al. | 379/406.09 |
| 5,584,295 | A | 12/1996 | Muller et al. | |
| 5,617,508 | A | 4/1997 | Reaves | |
| 5,677,987 | A | 10/1997 | Seki et al. | |
| 5,680,508 | A | 10/1997 | Liu | |
| 5,684,921 | A | 11/1997 | Bayya et al. | |
| 5,692,104 | A | 11/1997 | Chow et al. | |
| 5,701,344 | A | 12/1997 | Wakui | |
| 5,933,801 | A | 8/1999 | Fink et al. | |
| 5,937,377 | A | 8/1999 | Hardiman et al. | |
| 5,949,888 | A | 9/1999 | Gupta et al. | |
| 5,949,894 | A * | 9/1999 | Nelson et al. | 381/300 |
| 6,011,853 | A | 1/2000 | Koski et al. | |
| 6,160,886 | A * | 12/2000 | Romesburg et al. | 379/406.05 |
| 6,163,608 | A | 12/2000 | Romesburg et al. | |
| 6,167,375 | A | 12/2000 | Miseki et al. | |
| 6,173,074 | B1 | 1/2001 | Russo | |
| 6,175,602 | B1 | 1/2001 | Gustafsson et al. | |
| 6,182,035 | B1 | 1/2001 | Mekuria | |
| 6,192,134 | B1 | 2/2001 | White et al. | |
| 6,199,035 | B1 | 3/2001 | Lakaniemi et al. | |
| 6,405,168 | B1 | 6/2002 | Bayya et al. | |
| 6,415,253 | B1 * | 7/2002 | Johnson | 704/210 |
| 6,434,246 | B1 | 8/2002 | Kates et al. | |
| 6,507,814 | B1 | 1/2003 | Gao | |
| 6,587,816 | B1 | 7/2003 | Chazan et al. | |
| 6,643,619 | B1 | 11/2003 | Linhard et al. | |
| 6,681,202 | B1 | 1/2004 | Miet et al. | |
| 6,687,669 | B1 | 2/2004 | Schrögmeier et al. | |
| 6,766,292 | B1 | 7/2004 | Chandran et al. | |
| 6,782,363 | B2 | 8/2004 | Lee et al. | |
| 6,822,507 | B2 | 11/2004 | Buchele | |
| 6,859,420 | B1 | 2/2005 | Coney et al. | |
| 6,910,011 | B1 | 6/2005 | Zakarauskas | |
| 6,959,056 | B2 | 10/2005 | Yeap et al. | |
| 7,043,030 | B1 | 5/2006 | Furuta | |
| 7,117,145 | B1 * | 10/2006 | Venkatesh et al. | 704/200 |
| 7,117,149 | B1 | 10/2006 | Zakarauskas | |
| 7,133,825 | B2 | 11/2006 | Bou-Ghazale | |
| 7,171,003 | B1 | 1/2007 | Venkatesh et al. | |
| 7,464,029 | B2 | 12/2008 | Visser et al. | |
| 7,590,524 | B2 | 9/2009 | Kim | |
| 7,844,453 | B2 | 11/2010 | Hetherington | |
| 2001/0028713 | A1 | 10/2001 | Walker | |
| 2002/0071573 | A1 | 6/2002 | Finn | |
| 2002/0176589 | A1 | 11/2002 | Buck et al. | |
| 2003/0018471 | A1 * | 1/2003 | Cheng et al. | 704/233 |
| 2003/0040908 | A1 | 2/2003 | Yang et al. | |
| 2003/0191641 | A1 | 10/2003 | Acero et al. | |
| 2003/0216907 | A1 | 11/2003 | Thomas | |
| 2003/0216909 | A1 | 11/2003 | Davis et al. | |
| 2004/0078200 | A1 | 4/2004 | Alves | |
| 2004/0138882 | A1 | 7/2004 | Miyazawa | |
| 2004/0165736 | A1 | 8/2004 | Hetherington et al. | |
| 2004/0167777 | A1 | 8/2004 | Hetherington et al. | |
| 2005/0114128 | A1 | 5/2005 | Hetherington et al. | |
| 2005/0240401 | A1 | 10/2005 | Ebenezer | |
| 2006/0034447 | A1 | 2/2006 | Alves et al. | |
| 2006/0074646 | A1 | 4/2006 | Alves et al. | |
| 2006/0100868 | A1 | 5/2006 | Hetherington et al. | |
| 2006/0115095 | A1 | 6/2006 | Glesbrecht et al. | |
| 2006/0116873 | A1 | 6/2006 | Hetherington et al. | |
| 2006/0136199 | A1 | 6/2006 | Nongpiur et al. | |
| 2006/0251268 | A1 | 11/2006 | Hetherington et al. | |
| 2006/0287859 | A1 | 12/2006 | Hetherington et al. | |
| 2007/0033031 | A1 | 2/2007 | Zakarauskas | |
| 2007/0055508 | A1 | 3/2007 | Zhao et al. | |
| 2008/0046249 | A1 | 2/2008 | Thyssen et al. | |
| 2008/0243496 | A1 | 10/2008 | Wang | |
| 2009/0055173 | A1 | 2/2009 | Sehistedt | |
| 2009/0254340 | A1 | 10/2009 | Sun et al. | |
| 2009/0265167 | A1 | 10/2009 | Ehara et al. | |
| 2009/0276213 | A1 | 11/2009 | Hetherington | |

FOREIGN PATENT DOCUMENTS

| | | | |
|---|---|---|---|
| CA | 2157496 | | 10/1994 |
| CA | 2158064 | | 10/1994 |
| DE | 100 16 619 | A1 | 12/2001 |
| EP | 0 076 687 | A1 | 4/1983 |
| EP | 0 629 996 | A2 | 12/1994 |
| EP | 0 629 996 | A3 | 12/1994 |
| EP | 0 750 291 | A1 | 12/1996 |
| EP | 1 429 315 | A1 | 6/2004 |
| EP | 1 450 353 | A1 | 8/2004 |
| EP | 1 450 354 | A1 | 8/2004 |
| EP | 1 669 983 | A1 | 6/2006 |
| EP | 1 855 272 | A1 | 11/2007 |
| JP | 06269084 | A2 | 9/1994 |
| JP | 06319193 | A | 11/1994 |
| WO | WO 00/41169 | A1 | 7/2000 |
| WO | WO 01/56255 | A1 | 8/2001 |
| WO | WO 01/73761 | A1 | 10/2001 |

OTHER PUBLICATIONS

Ortega, A. et al., "Speech Reinforce Inside Vehicles," AES, Jun. 1, 2002; pp. 1-9.

Avendano, C., Hermansky, H., "Study on the Dereverberation of Speech Based on Temporal Envelope Filtering," Proc. ICSLP '96, pp. 889-892, Oct. 1996.

Berk et al., "Data Analysis with Microsoft Excel", Duxbury Press, 1998, pp. 236-239 and 256-259.

Fiori, S., Uncini, A., and Piazza, F., "Blind Deconvolution by Modified Bussgang Algorithm", Dept. of Electronics and Automatics—University of Ancona (Italy), ISCAS 1999.

Learned, R.E. et al., A Wavelet Packet Approach to Transient Signal Classification, Applied and Computational Harmonic Analysis, Jul. 1995, pp, 265-278, vol. 2, No. 3, USA, XP 000972660. ISSN: 1063-5203. abstract.

Nakatani, T., Miyoshi, M., and Kinoshita, K., "Implementation and Effects of Single Channel Dereverberation Based on the Harmonic Structure of Speech," Proc. of IWAENC-2003, pp. 91-94, Sep. 2003.

Puder, H. et al., "Improved Noise Reduction for Hands-Free Car Phones Utilizing Information on a Vehicle and Engine Speeds", Sep. 4-8, 2000, pp. 1851-1854, vol. 3, XP009030255, 2000. Tampere, Finland, Tampere Univ. Technology, Finland Abstract.

Quatieri, T.F. et al., Noise Reduction Using a Soft-Decision Sine-Wave Vector Quantizer, International Conference on Acoustics, Speech & Signal Processing, Apr. 3, 1990, pp. 821-824, vol. Conf. 15, IEEE ICASSP, New York, US XP000146895, Abstract, Paragraph 3.1.

Quelavoine, R. et al., Transients Recognition in Underwater Acoustic with Multilayer Neural Networks, Engineering Benefits from Neural Networks, Proceedings of the International Conference EANN 1998, Gibraltar, Jun. 10-12, 1998 pp. 330-333, XP 000974500. 1998, Turku, Finland, Syst. Eng. Assoc., Finland. ISBN: 951-97868-0-5. abstract, p. 30 paragraph 1.

Seely, S., "An Introduction to Engineering Systems", Pergamon Press Inc., 1972, pp. 7-10.

Shust, Michael R. and Rogers, James C., Abstract of "Active Removal of Wind Noise From Outdoor Microphones Using Local Velocity Measurements", *J. Acoust. Soc. Am.*, vol. 104, No. 3, Pt 2, 1998, 1 page.

Shust, Michael R. and Rogers, James C., "Electronic Removal of Outdoor Microphone Wind Noise", obtained from the Internet on Oct. 5, 2006 at: <http://www.acoustics.org/press/136th/mshust.htm>, 6 pages.

Simon, G., Detection of Harmonic Burst Signals, International Journal Circuit Theory and Applications, Jul. 1985, vol. 13, No. 3, pp. 195-201, UK, XP 000974305. ISSN: 0098-9886. abstract.

Vieira, J., "Automatic Estimation of Reverberation Time", Audio Engineering Society, Convention Paper 6107, 116th Convention, May 8-11, 2004, Berlin, Germany, pp. 1-7.

Wahab A. et al., "Intelligent Dashboard With Speech Enhancement", Information, Communications, and Signal Processing, 1997. ICICS, Proceedings of 1997 International Conference on Singapore, Sep. 9-12, 1997, New York, NY, USA, IEEE, pp. 993-997.
Zakarauskas, P., Detection and Localization of Nondeterministic Transients in Time series and Application to Ice-Cracking Sound, Digital Signal Processing, 1993, vol. 3, No. 1, pp. 36-45, Academic Press, Orlando, FL, USA, XP 000361270, ISSN: 1051-2004. entire document.

* cited by examiner

Noise Contributions on Mic

AMBIENT NOISE COMPENSATION SYSTEM ROBUST TO HIGH EXCITATION NOISE

PRIORITY CLAIM

This application is a continuation-in-part of U.S. Ser. No. 12/428,811, entitled "Robust Downlink Speech and Noise Detector," filed Apr. 23, 2009; and is a continuation-in-part of U.S. Ser. No. 11/644,414, entitled "Robust Noise Estimation," filed Dec. 22, 2006; and claims the benefit of priority from U.S. Ser. No. 61/055,913 entitled "Ambient Noise Compensation System Robust to High Excitation Noise," filed May 23, 2008, all of which are incorporated by reference.

BACKGROUND OF THE INVENTION

1. Technical Field

This disclosure relates to ambient noise compensation, and more particularly to an ambient noise compensation system that prevents uncontrolled gain adjustments.

2. Related Art

Some ambient noise estimation involves a form of noise smoothing that may track slowly varying signals. If an echo canceller is not successful in removing an echo entirely, this may affect ambient noise estimation. Echo artifacts may be of short duration.

In some cases the excitation signal may be slowly varying. For example, when a call is made and received between two vehicles. One vehicle may be traveling on a concrete highway, perhaps it is a convertible. High levels of constant noise may mask or exist on portions of the excitation signal received and then played in the second car. This downlink noise may be known as an excitation noise. An echo canceller may reduce a portion of this noise, but if the true ambient noise in the enclosure is very low, then the residual noise may remain after an echo canceller processes. The signal may also dominate a microphone signal. Under these circumstances, the ambient noise may be overestimated. When this occurs, a feedback loop may be created where an increase in the gain of the excitation signal (or excitation noise) may cause an increase in the estimated ambient noise. This condition may cause a gain increase in the excitation signal (or excitation noise).

SUMMARY

A speech enhancement system controls the gain of an excitation signal to prevent uncontrolled gain adjustments. The system includes a first device that converts sound waves into operational signals. An ambient noise estimator is linked to the first device and an echo canceller. The ambient noise estimator estimates how loud a background noise would be near the first device prior to an echo cancellation. The system then compares the ambient noise estimate to a current ambient noise estimate near the first device to control a gain of an excitation signal.

Other systems, methods, features, and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawing and descriptions. The components in the figures are not necessarily to scale, emphasis instead being placed upon illustrating the principles of the invention. Moreover, in the figure, like referenced numerals designate corresponding parts throughout the different views.

DETAILED DESCRIPTION OF THE PREFERRED EMBODIMENTS

Ambient noise compensation may ensure that audio played in an environment may be heard above the ambient noise within that environment. The signal that is played may be speech, music, or some other sound such as alerts, beeps, or tones. The signal may also be known as an excitation signal. Ambient noise level may be estimated by monitoring signal levels received at a microphone that is within an enclosure into which the excitation signal may be played. A microphone may pick up an ambient noise and an excitation signal. Some systems may include an echo canceller that reduces the contribution of the excitation signal to the microphone signal. The systems may estimate the ambient noise from the residual output of the microphone.

Figure 4:
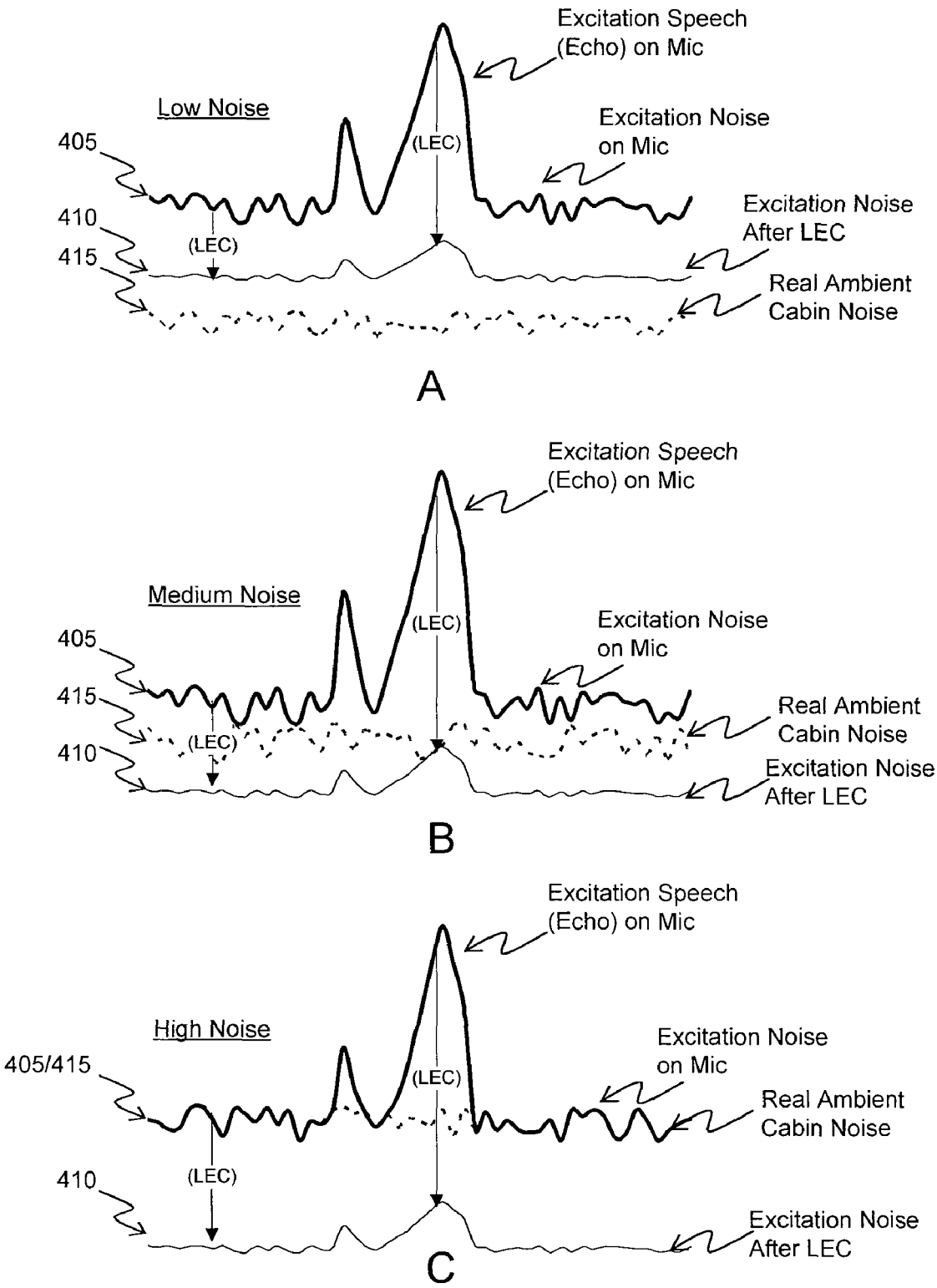
FIG. 4 illustrates contributions to noise received at an input.

Some systems attempt to estimate a noise level near a device that converts sound waves into analog or digital signals (e.g., a microphone) prior to processing the signal through an echo canceller. The system may compare (e.g., through a comparator) this estimate to the current ambient noise estimate at the microphone, which may be measured after an echo cancellation. If the excitation noise played out or transmitted into the environment is expected to be of lower magnitude than the ambient noise (e.g., FIG. 4C), then a feedback may not occur. If the excitation noise is expected to be of a higher magnitude than the ambient noise (e.g., FIG. 4A and FIG. & 4B: 405 vs. 415), then a feedback may occur. The feedback may depend on how much louder the excitation noise is and how much the excitation noise may be expected to be reduced by an echo canceller. For example, if the echo canceller may reduce a signal by 25 dB and the expected excitation noise is only 10 dB higher than the ambient noise estimate (e.g., 405 in FIG. 4C), and then the system may be programmed to conclude that the noise estimated is the ambient cabin noise. The system programming may further conclude that the ambient cabin noise includes no (or little) contribution from the excitation signal. If an expected excitation noise is more than 20 dB or so than the ambient noise estimate (e.g., 405 in FIG. 4A) then it is possible, even likely, for the system's programming to conclude that part or all of the noise estimated is the excitation noise and its signal level does not represent the a true ambient noise in the vehicle.

When a situation like the one described above occurs, a flag is raised or a status marker may be set to indicate that the excitation noise is too high. The system may determine that further increases in gain made to the excitation signal should not occur. In addition, if any gain currently being made to the excitation signal prior to the signals transmission to an enclosure (e.g., in a vehicle) through an amplifier/attenuator then the current gain may also be reduced until the flag or status indicator is cleared.

Figure 1:
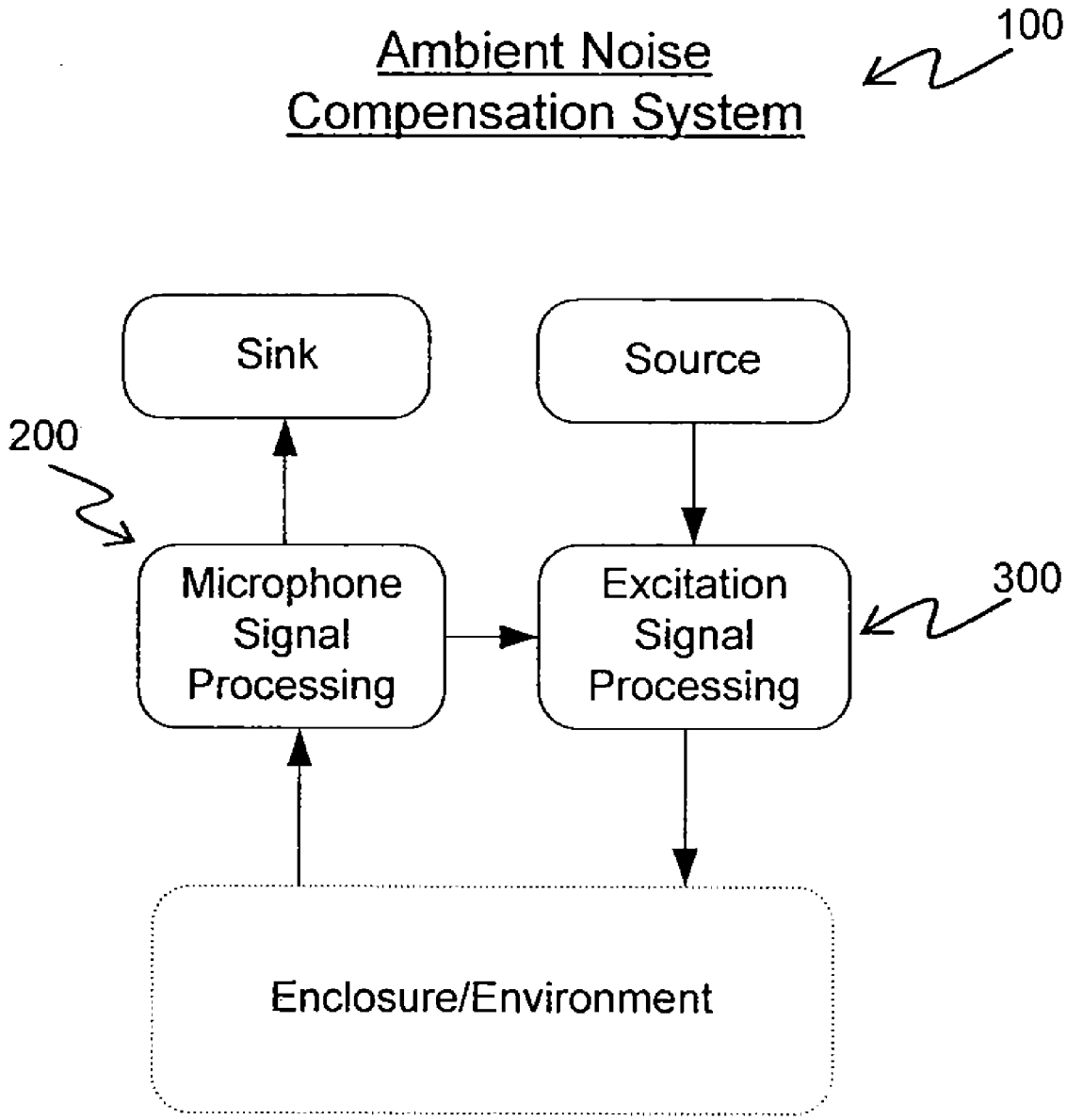
FIG. 1 is an ambient noise compensation system.

The programming may be integrated within or may be a unitary part of an ambient noise compensation system of FIG. 1. A signal from some source may be transmitted or played out through a speaker into an acoustic environment and a receiver such as a microphone or transducer may be used to measure noise within that environment. Processing may be done on the input signal (e.g., microphone signal 200) and the result may be conveyed to a sink which may comprise a local or remote device or may comprise part of a local or remote device that receives data or a signal from another device. A source and a sink in a hands free phone system may be a far-end caller transceiver, for example.

Figure 2:
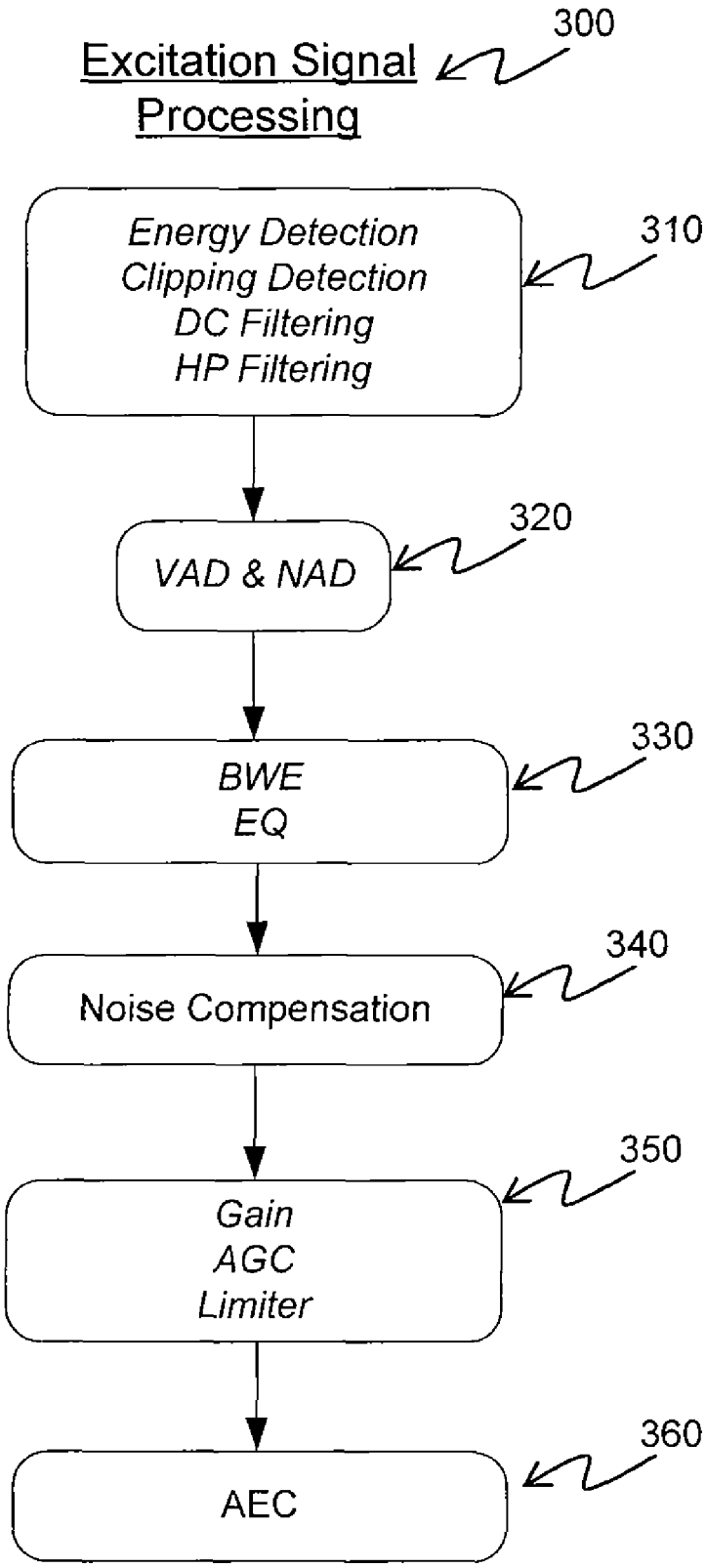
FIG. 2 is an excitation signal process.

In some systems, the ambient noise compensation is envisioned to lie within excitation signal processing 300 shown in FIG. 2. In FIG. 2, the excitation signal may undergo several operations before being transmitted or played out into an environment. It may be DC filtered and/or High-pass filtered and it may be analyzed for clipping and/or subject to other energy or power measurements or estimates, as at 310.

In some processes, there may be voice and noise decisions made on the signal, as in 320. These decisions may include those made in the systems and methods described in U.S. Ser. No. 12/428,811, entitled "Robust Downlink Speech and Noise Detector" filed Apr. 23, 2009, which is incorporated by reference. Some processes know when constant noise is transmitted or being played out. This may be derived from Noise Decision 380 described in the systems and methods described in the "Robust Downlink Speech and Noise Detector" patent application.

There may be other processes operating on the excitation signal, as at 330. For example, the signal's bandwidth may be extended (BWE). Some systems extend bandwidth through the systems and methods described in Ser. No. 11/317,761, entitled "Bandwidth Extension of Narrowband Speech" filed Dec. 23, 2005, and/or Ser. No. 11/168,654, entitled "Frequency Extension of Harmonic Signals" filed Jun. 28, 2005, both of which is incorporated by reference. Some systems may compensate for frequency distortion through an equalizer (EQ). The signal's gain may then be modified in Noise Compensation 340 in relation to the ambient noise estimate from the microphone signal processing 200 of FIG. 2. Some systems may modify gain through the systems and methods described in U.S. Ser. No. 11/130,080, entitled "Adaptive Gain Control System" filed May 16, 2005, which is incorporated by reference.

In some processes, the excitation signal's gain may be automatically or otherwise adjusted (in some applications, through the systems and methods described or to be described) and the resulting signal limited at 350. In addition, the signal may be given as a reference to echo cancellation unit 360 which may then serve to inform the process of an expected level of the excitation noise.

In the noise compensation act 340, a gain is applied at 345 (of FIG. 3) to the excitation signal that is transmitted or played out into the enclosure. To prevent a potential feedback loop, logic may determine whether the level of pseudo-constant noise on the excitation signal is significantly higher than the ambient noise in the enclosure. To accomplish this, the process may use an indicator of when noise is being played out, as in 341. This indicator may be supplied by a voice activity detector or a noise activity detector 320. The voice activity detector may include the systems and methods described in U.S. Ser. No. 11/953,629, entitled "Robust Voice Detector for Receive-Side Automatic Gain Control" filed Dec. 10, 2007, and/or Ser. No. 12/428,811, entitled "Robust Downlink Speech and Noise Detector" filed Apr. 23, 2009, both of which are incorporated by reference.

If a current excitation signal is not noise then the excitation signal may be adjusted using the current noise compensation gain value. If a current signal is noise, then its magnitude when converted by the microphone/transducer/receiver may be estimated at 342. The estimate may use a room coupling factor that may exist in an acoustic echo canceller 360. This room coupling factor may comprise a measured, estimated, and/or pre-determined value that represents the ratio of excitation signal magnitude to microphone signal magnitude when only excitation signal is playing out into the enclosure. The room coupling factor may be frequency dependent, or may be simplified into a reduced set of frequency bands, or may comprise an averaged value, for example. The room coupling factor may be multiplied by the current excitation signal (through a multiplier), which has been determined or designated to be noise, and the expected magnitude of the excitation noise at the microphone may be estimated.

Alternatively, the estimate may use a different coupling factor that may be resident to the acoustic echo canceller 360. This alternative coupling factor may be an estimated, measured, or pre-determined value that represents the ratio of excitation signal magnitude to the error signal magnitude after a linear filtering device stage of the echo canceller 360. The error coupling factor may be frequency dependent, or may be simplified into a reduced set of frequency bands, or may comprise an averaged value. The error coupling factor may be multiplied by the current excitation signal (through a multiplier), which has been determined to be noise, or by the excitation noise estimate, and the expected magnitude of the excitation noise at the microphone may be estimated.

The process may then determine whether an expected level of excitation noise as measured at the microphone is too high. At 344 the expected excitation noise level at the microphone at 342 may be compared to a microphone noise estimate (such as described in the systems and methods of U.S. Ser. No. 11/644,414 entitled "Robust Noise Estimation," which is incorporated by reference) that may be completed after the acoustic echo cancellation. If an expected excitation noise level is at or below the microphone noise level, then the process may determine that the ambient noise being measured has no contribution from the excitation signal and may be used to drive the noise compensation gain parameter applied at 345. If however the expected excitation noise level exceeds the ambient noise level, then the process may determine that a significant portion of raw microphone signal comes is originating from the excitation signal. The outcomes of these occurrences may not occur frequently because the linear filter that may interface or may be a unitary part of the echo canceller may reduce or effectively remove the contribution of the excitation noise, leaving a truer estimate of the ambient noise. If the expected excitation noise level is higher than the ambient noise estimate by a predetermined level (e.g., an amount that exceeds the limits of the linear filter), then the ambient noise estimate may be contaminated by the excitation noise. To be conservative some systems apply a predetermined threshold, such as about 20 dB, for example. So, if the expected excitation noise level is more than the predetermined threshold (e.g., 20 dB) above the ambient noise estimate, a flag or status marker may be set at 344 to indicate that the excitation noise is too high. The contribution of the excitation to the estimated ambient noise may also be made more directly using the error coupling factor, described above.

If an excitation noise level is too high then the noise compensation gain that is being applied to the excitation signal may be reduced at 343 to prevent a feedback loop. Alternatively, further increases in noise compensation gain may simply be stopped while this flag is set (e.g., or not cleared). This prevention of gain increase or actual gain reduction may be accomplished several ways, each of which may be expected to similarly prevent the feedback loop.

Figure 3:
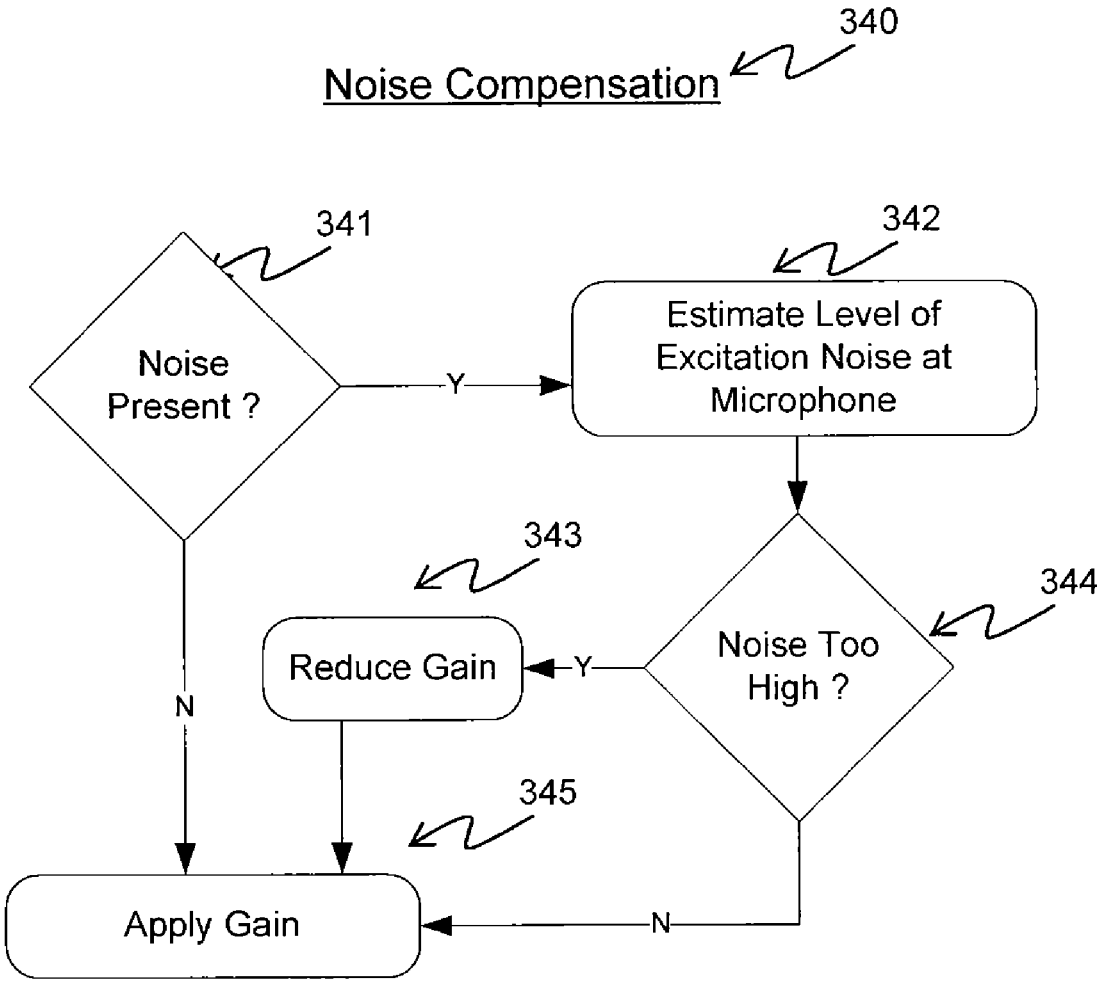
FIG. 3 is a noise compensation process.

The methods and descriptions of FIGS. 1-3 may be encoded in a signal bearing medium, a computer readable storage medium such as a memory that may comprise unitary or separate logic, programmed within a device such as one or more integrated circuits, or processed by a controller or a computer. If the methods are performed by software, the software or logic may reside in a memory resident to or interfaced to one or more processors or controllers, a wireless communication interface, a wireless system, an entertainment and/or comfort controller of a vehicle or types of non-volatile or volatile memory remote from or resident to a speech enhancement system. The memory may retain an ordered listing of executable instructions for implementing logical functions. A logical function may be implemented through digital circuitry, through source code, through analog circuitry, or through an analog source such through an analog electrical, or audio signals. The software may be embodied in any computer-readable medium or signal-bearing medium, for use by, or in connection with an instruction executable system, apparatus, device, resident to a hands-free system or communication system or audio system and/or may be part of a vehicle. In alternative systems the computer-readable media component may include a firmware component that is implemented as a permanent memory module such as ROM. The firmware may programmed and tested like software, and may be distributed with a processor or controller. Firmware may be implemented to coordinate operations of the processor or controller and contains programming constructs used to perform such operations. Such systems may further include an input and output interface that may communicate with an automotive or wireless communication bus through any hardwired or wireless automotive communication protocol or other hardwired or wireless communication protocols.

A computer-readable medium, machine-readable medium, propagated-signal medium, and/or signal-bearing medium may comprise any medium that includes, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical or tangible connection having one or more wires, a portable magnetic or optical disk, a volatile memory such as a Random Access Memory "RAM" (electronic), a Read-Only Memory "ROM," an Erasable Programmable Read-Only Memory (EPROM or Flash memory), or an optical fiber. A machine-readable medium may also include a tangible medium upon which software is printed, as the software may be electronically stored as an image or in another format (e.g., through an optical scan), then compiled by a controller, and/or interpreted or otherwise processed. The processed medium may then be stored in a local or remote computer and/or machine memory.

Other alternate systems and methods may include combinations of some or all of the structure and functions described above or shown in one or more or each of the figures. These systems or methods are formed from any combination of structure and function described or illustrated within the figures or incorporated by reference. Some alternative systems interface or include the systems and methods described in Ser. No. 11/012,079, entitled "System for Limiting Receive Audio" filed Dec. 14, 2004 as the context dictates, which is incorporated by reference. Some alternative systems are compliant with one or more of the transceiver protocols may communicate with one or more in-vehicle displays, including touch sensitive displays. In-vehicle and out-of-vehicle wireless connectivity between the systems, the vehicle, and one or more wireless networks provide high speed connections that allow users to initiate or complete a communication or a transaction at any time within a stationary or moving vehicle. The wireless connections may provide access to, or transmit, static or dynamic content (live audio or video streams, for example). As used in the description and throughout the claims a singular reference of an element includes and encompasses plural references unless the context clearly dictates otherwise.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A speech enhancement system, comprising:

a first device that converts sound waves into operational signals;

an ambient noise estimator coupled to the first device; and an echo canceller coupled to the first device and the ambient noise estimator to dampen a sound;

where the ambient noise estimator estimates how loud a background noise resulting from an excitation signal played over a speaker would be in a signal captured by the first device, where the ambient noise estimator compares the background noise estimate resulting from the excitation signal to a current ambient noise estimate near the first device, and where the ambient noise estimator reduces a gain of the excitation signal or stops further increases in the gain of the excitation signal in response to a determination that the background noise estimate associated with the excitation signal is higher than the current ambient noise estimate by a predetermined level.

2. The speech enhancement system of claim 1 where a comparator compares estimates of the background noise and the current ambient noise estimate.

3. The speech enhancement system of claim 2 where the gain of the excitation signal is controlled at an output of a device that converts electric signals into an audible sound.

4. The speech enhancement system of claim 2 where the comparator is configured to differentiate between an ambient noise and a composite noise.

5. The speech enhancement system of claim 1 where the gain of the excitation signal is controlled at an output of a device that converts electric signals to an audible sound.

6. The speech enhancement system of claim 1 where the ambient noise estimator comprises a transducer.

7. The speech enhancement system of claim 1 further comprising a transceiver in communication with a sink that is remote from the first device and the echo canceller.

8. The speech enhancement system of claim 1 where the first device is compliant with a transceiver protocol of a remote source and a remote sink is compliant with a transceiver protocol of a transceiver that is local to, and receives an output from the echo canceller.

9. The speech enhancement system of claim 8 where the remote source and the remote sink comprises a unitary device.

10. The speech enhancement system of claim 8 where the transceiver and echo canceller comprises part of a hands free phone system.

11. The speech enhancement system of claim 1 where the ambient noise estimator is configured to estimate how loud the background noise would be near the first device based on an enclosure's coupling factor and the excitation signal.

12. A speech enhancement system, comprising:

a first device that converts sound waves into operational signal;

an ambient noise estimator coupled to the first device; and an echo canceller coupled to the first device and the ambient noise estimator to dampen a sound;

where the ambient noise estimator calculates an estimate of a background noise near the first device, where the ambient noise estimator calculates the estimate from an excitation signal and a coupling factor, and where the ambient noise estimator performs a comparison between the estimate and a current ambient noise estimate near the first device to control a gain of the excitation signal based on an outcome of the comparison; and where the ambient noise estimator reduces the gain of the excitation signal or stops further increases in the gain of the excitation signal in response to a determination that the estimate from the excitation signal and the coupling factor is higher than the current ambient noise estimate by a predetermined level.

13. The speech enhancement system of claim 12 where a comparator compares estimates of the background noise and the current ambient noise estimate.

14. The speech enhancement system of claim 13 where the gain of the excitation signal is controlled at an output of a device that converts electric signals into an audible sound.

15. The speech enhancement system of claim 13 where the comparator is configured to differentiate between an ambient noise and a composite noise.

16. The speech enhancement system of claim 12 where the gain of the excitation signal is controlled at an output of a device that converts electric signals to an audible sound.

17. The speech enhancement system of claim 12 where the ambient noise estimator comprises a transducer.

18. The speech enhancement system of claim 12 further comprising a transceiver in communication with a sink that is remote from the first device and the echo canceller.

19. The speech enhancement system of claim 12 where the first device is compliant with a transceiver protocol of a remote source and a remote sink is compliant with a transceiver protocol of a transceiver that is local to, and receives an output from the echo canceller.

20. The speech enhancement system of claim 19 where the remote source and the remote sink comprise a unitary device.

21. The speech enhancement system of claim 19 where the transceiver and echo canceller comprise parts of a hands free phone system.

22. The speech enhancement system of claim 12 where the coupling factor comprises a room coupling factor that represents a ratio of excitation signal magnitude to microphone signal magnitude when only the excitation signal is playing out into an enclosure.

23. The speech enhancement system of claim 12 where the ambient noise estimator reduces the gain of the excitation signal in response to the determination that the estimate from the excitation signal and the coupling factor is higher than the current ambient noise estimate by the predetermined level.

24. The speech enhancement system of claim 12 where the ambient noise estimator stops further increases in the gain of the excitation signal in response to the determination that the estimate from the excitation signal and the coupling factor is higher than the current ambient noise estimate by the predetermined level.

25. The speech enhancement system of claim 12 where the ambient noise estimator calculates the estimate of the background noise near the first device after an echo cancellation by the echo canceller.

26. The speech enhancement system of claim 12 where the coupling factor comprises an error coupling factor that represents a ratio of excitation signal magnitude to error signal magnitude after a linear filtering device stage of the echo canceller.

* * * * *